US010605462B2

(12) United States Patent
Todd

(10) Patent No.: US 10,605,462 B2
(45) Date of Patent: Mar. 31, 2020

(54) MAIN TOP OF A COOKTOP APPLIANCE

(71) Applicant: Haier US Appliance Solutions, Inc., Wilmington, DE (US)

(72) Inventor: Justin Patrick Todd, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 578 days.

(21) Appl. No.: 15/351,528

(22) Filed: Nov. 15, 2016

(65) Prior Publication Data

US 2018/0135862 A1 May 17, 2018

(51) Int. Cl.
*F24C 3/08* (2006.01)
*F24C 3/12* (2006.01)

(52) U.S. Cl.
CPC ..... *F24C 3/124* (2013.01); *F24C 3/085* (2013.01)

(58) Field of Classification Search
USPC ..... 126/39 B
See application file for complete search history.

(56) References Cited

U.S. PATENT DOCUMENTS 3,375,819 A 4/1968 Davis
4,562,827 A * 1/1986 Cerola ..... F24C 15/2042 126/299 R
4,705,019 A 11/1987 Beach et al.
D580,224 S * 11/2008 Geiger ..... D7/408
8,757,138 B2 6/2014 Shaffer et al.
D782,863 S * 4/2017 Kamper ..... D7/339
2007/0295323 A1* 12/2007 Delzell ..... F24C 15/10 126/214 R
2013/0327314 A1* 12/2013 Green ..... F24C 15/10 126/39 B
2013/0327315 A1* 12/2013 Sosso ..... F24C 15/20 126/39 E
2015/0153047 A1* 6/2015 Moro ..... F23N 1/007 99/332
2016/0069571 A1* 3/2016 Lewis, Jr. ..... F24C 3/124 99/337

FOREIGN PATENT DOCUMENTS

EP 2072901 A1 6/2009
JP 3754202 B2 3/2006
WO WO2013026767 A1 2/2013

* cited by examiner

*Primary Examiner* — Steven B McAllister
*Assistant Examiner* — John E Bargero
(74) *Attorney, Agent, or Firm* — Dority & Manning, P.A.

(57) ABSTRACT

A main top of a gas cooktop appliance defining vertical, lateral, and transverse directions includes a front edge, a bottom surface, a top surface, and a transition surface. The front and rear edges are spaced apart from one another along the transverse direction. The bottom surface is positioned between the front and rear edges along the transverse direction, and the bottom defines a first plurality of openings. The top surface is spaced apart from the bottom surface along the vertical direction, and the top surface surrounds a perimeter of the bottom surface. The top surface defines a second plurality of openings positioned between the bottom surface and the front edge along the transverse direction. The transition surface extends between the bottom surface and the top surface along the vertical direction, and is spaced apart from the front edge along the transverse direction. The transition surface also defines an opening.

16 Claims, 11 Drawing Sheets

MAIN TOP OF A COOKTOP APPLIANCE

FIELD OF THE INVENTION

The present subject matter relates generally to cooktop appliances, such as a gas cooktop appliance with gas burner assemblies.

BACKGROUND OF THE INVENTION

Gas cooktop appliances include a plurality of gas burners mounted to a main top or top panel of the appliance. Gas burners are known to generate carbon monoxide while being fired. Carbon monoxide is known to be harmful to humans if inhaled at a sufficiently high concentration. If a gas cooktop is not adequately vented, the carbon monoxide concentration in a living space can build up to toxic levels. It has been determined that a concentration of carbon monoxide compensated for excess air, or air free carbon monoxide (AFCO), of greater than 800 parts per million (ppm) is unsafe for human inhabitants in the living space. Accordingly, safety organizations, such as the American Gas Association (AGA), require gas cooktops produce no more than 800 ppm AFCO. It is further known that one of the primary causes of carbon monoxide generation in gas burners is incomplete combustion.

In the past, various techniques have been employed to assure complete combustion. For example, port to pot height (e.g., the vertical distance between the flame port of a gas burner and the bottom surface of a cooking utensil positioned on a burner grate) may be increased. As another example, the diameter of the burner orifices may be reduced. Each of these techniques may be used to keep AFCO production below 800 ppm. However, these techniques may also reduce the heat transfer efficiency or heat output rate [British Thermal Units (BTU)/Hour] of the gas burner and, as a consequence, may increase cooking times, such as by increasing the time to boil rating for the burner.

Accordingly, a cooktop appliance with features for reducing both carbon monoxide production and cooking times is desirable.

BRIEF DESCRIPTION OF THE INVENTION

Additional aspects and advantages of the invention will be set forth in part in the following description, or may be apparent from the description, or may be learned through practice of the invention.

In a first exemplary embodiment, a main top of a gas cooktop appliance defining vertical, lateral, and transverse directions includes a front edge, a bottom surface, a top surface, and a transition surface. The front and rear edges may be spaced apart from one another along the transverse direction, and the bottom surface may be positioned between the front and rear edges along the transverse direction. In addition, the bottom surface may define a first plurality of openings. The top surface may be spaced apart from the bottom surface along the vertical direction. More specifically, the top surface may surround a perimeter of the bottom surface. In addition, the top surface may define a second plurality of openings positioned between the bottom surface and the front edge along the transverse direction. The transition surface may extend between the bottom surface and the top surface along the vertical direction. In addition, the transition surface may be spaced apart from the front edge along the transverse direction, and may also define an opening.

In a second exemplary embodiment, a gas cooktop appliance defining vertical, lateral, and transverse directions includes a plurality of gas burner assemblies, a plurality of knobs, a burner box defining a cavity, and a main top. Each of the plurality of gas burner assemblies includes a burner base, and each knob of the plurality of knobs may be operatively coupled to one of the plurality of burner assemblies. The main top includes a front edge, a bottom surface, a top surface, and a transition surface. The front and rear edges may be spaced apart from one another along the transverse direction, and the bottom surface may be positioned between the front and rear edges along the transverse direction. In addition, the bottom surface may define a first plurality of openings. The top surface may be spaced apart from the bottom surface along the vertical direction. More specifically, the top surface may surround a perimeter of the bottom surface. In addition, the top surface may define a second plurality of openings positioned between the bottom surface and the front edge along the transverse direction. The transition surface may extend between the bottom surface and the top surface along the vertical direction. In addition, the transition surface may be spaced apart from the front edge along the transverse direction, and may also define an opening.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
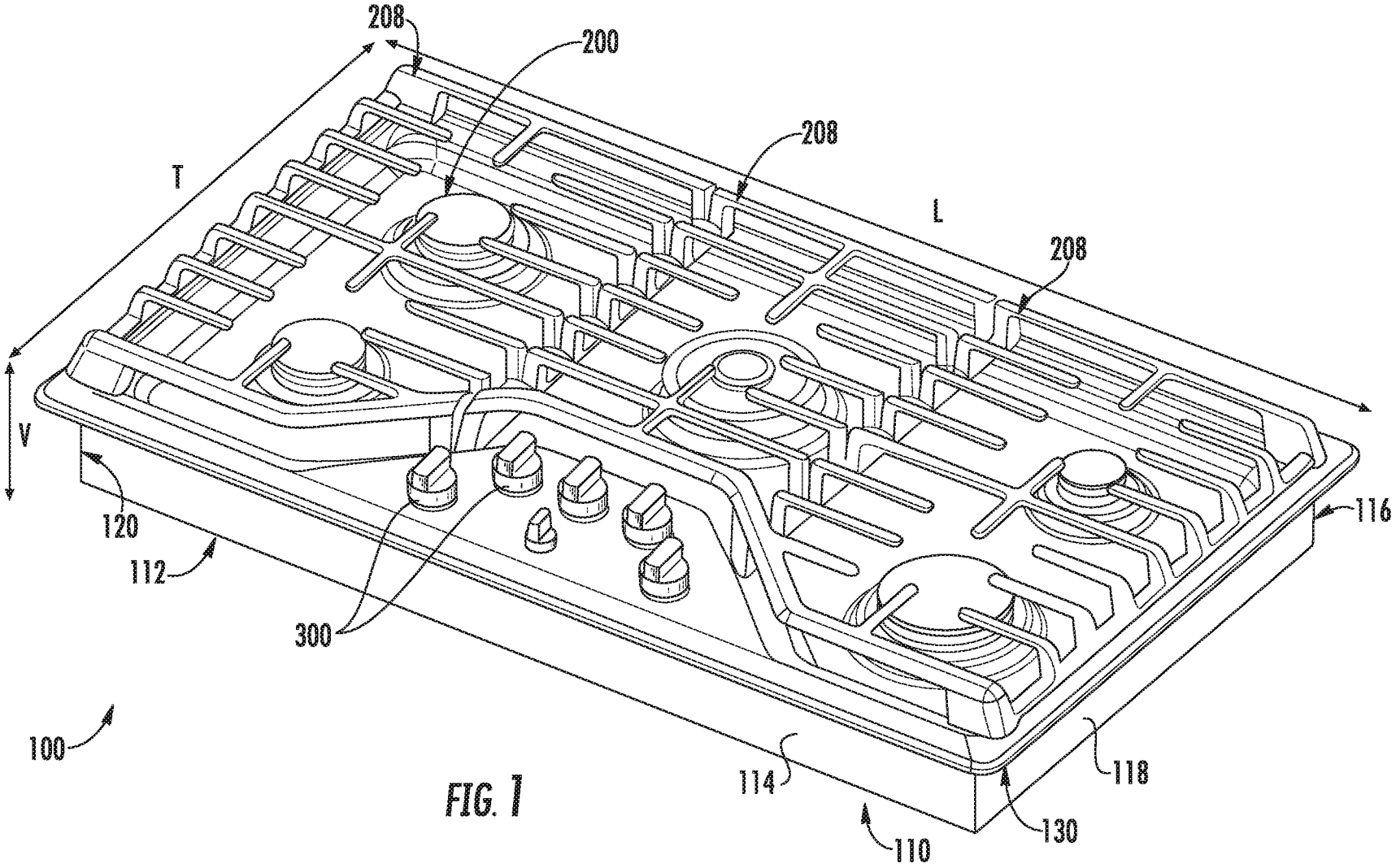
FIG. 1 provides a top, perspective view of a cooktop appliance according to an exemplary embodiment of the present subject matter.
Figure 2:
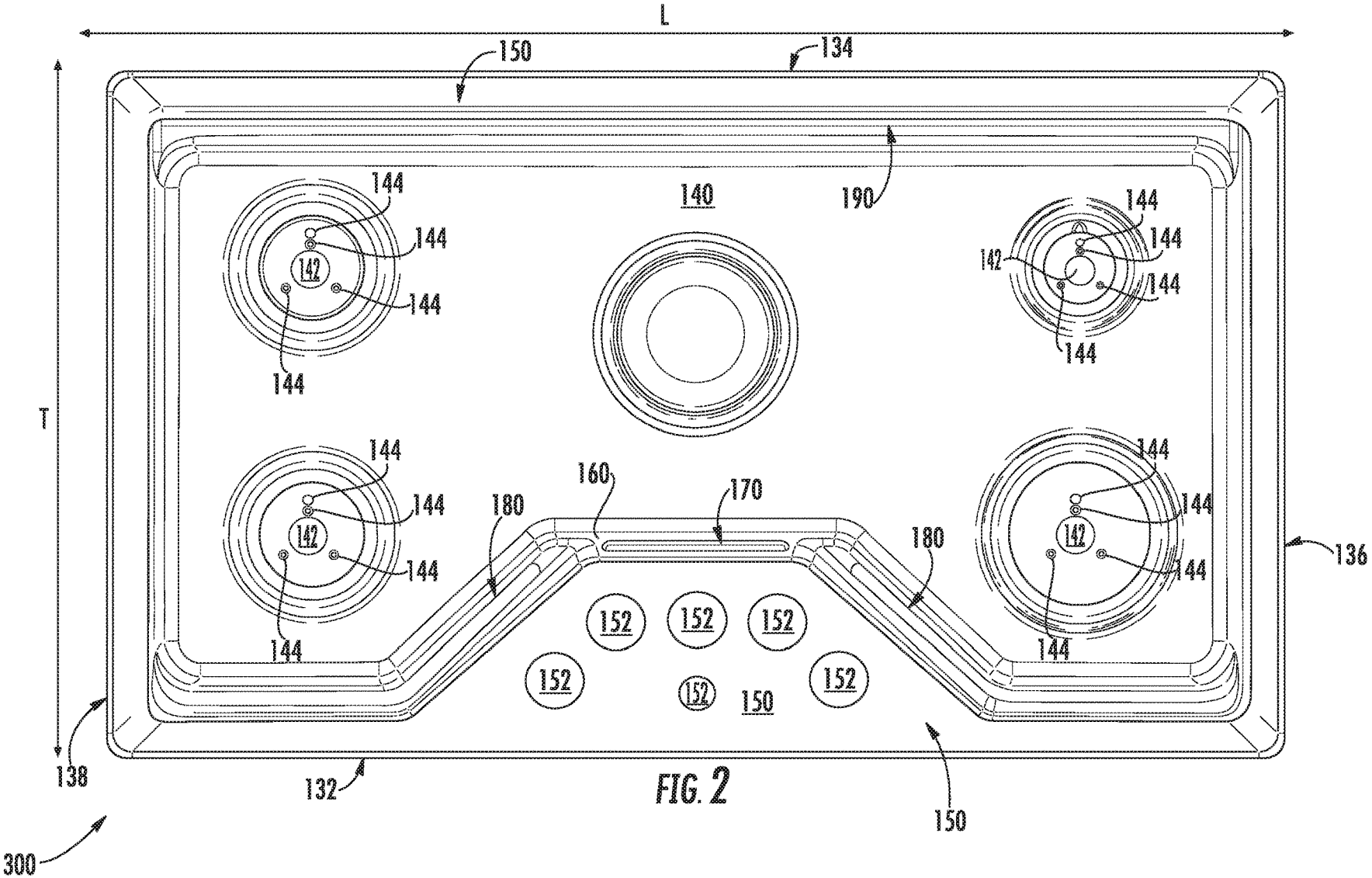
FIG. 2 provides a top-down view of an exemplary main top of the exemplary cooktop appliance depicted in FIG. 1.
Figure 3:
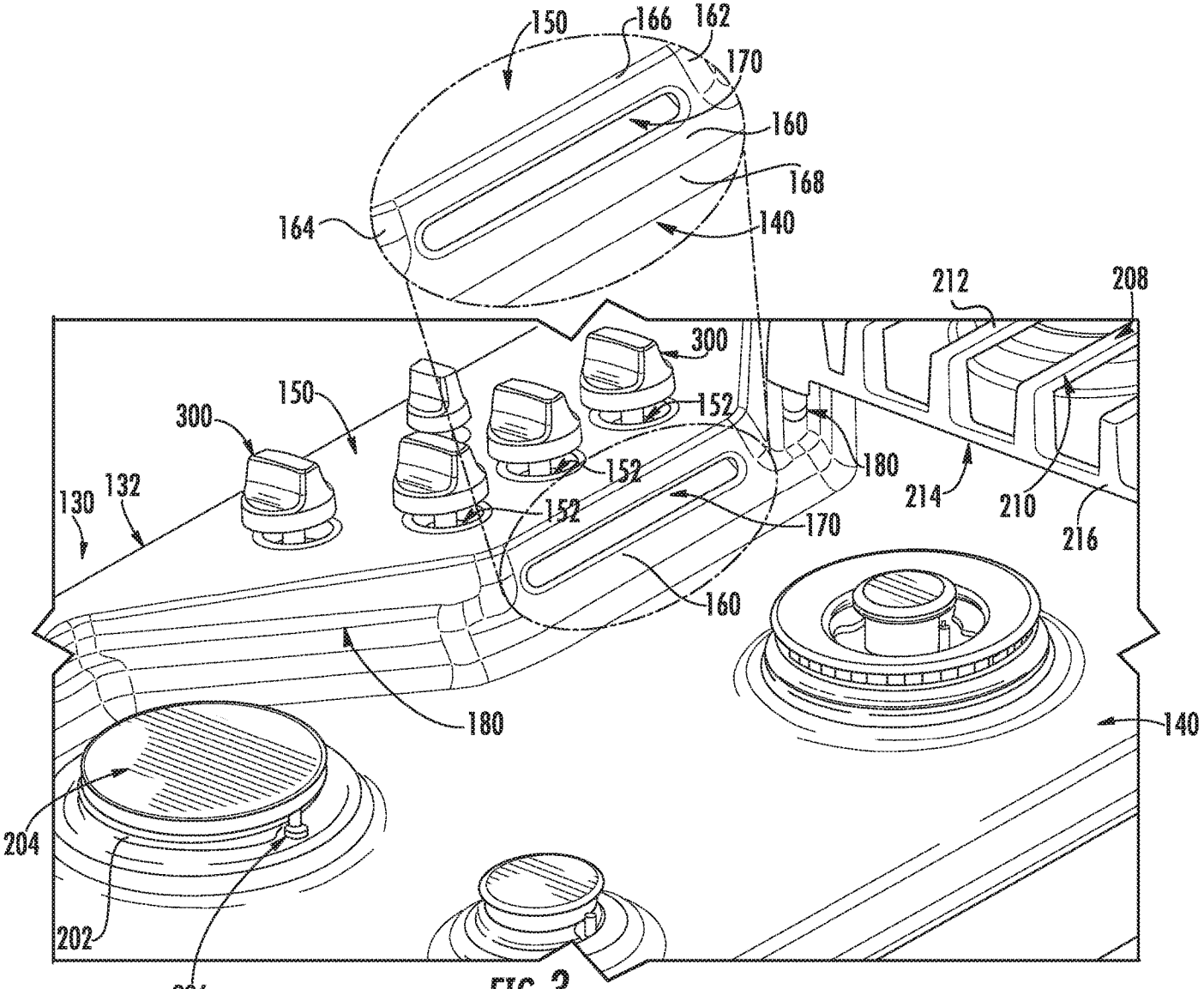
FIG. 3 provides an enlarged view of a portion of the exemplary cooktop appliance depicted in FIG. 1.

Repeat use of reference characters in the present specification and drawings is intended to represent the same or analogous features or elements of the present invention

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 depicts an exemplary embodiment of a cooktop appliance 100 as may be employed with the present subject matter. The cooktop appliance 100 defines a vertical direction V, a lateral direction L, and a transverse direction T. The vertical, lateral, and transverse directions are mutually perpendicular to one another and form an orthogonal coordinate system. As shown, the cooktop appliance 100 includes a burner box 110.

The burner box 110 includes a bottom wall 112, a front wall 114, a rear wall 116, and a pair of opposing side walls 118, 120. The front and rear walls 114, 116 are spaced apart from one another along the transverse direction T, and both the front and rear walls 114, 116 extend from the bottom wall 112 along the vertical direction V. In addition, the opposing side walls 118, 120 are spaced apart from one another along the lateral direction L, and each opposing side wall 118, 120 extends between the front and rear walls 114, 116 along the transverse direction T.

The cooktop appliance 100 also includes a main top or top panel 130. The main top 130 may be constructed from any suitable material. For example, the main top 130 may be constructed of enameled steel, stainless steel, glass, ceramics, or combinations thereof. When the cooktop appliance 100 is assembled, the main top 130 may be positioned on the burner box 110 to enclose the cavity 122 defined by the burner box 110. More specifically, when the main top 130 is positioned on the burner box 110, the cavity 122 may be defined between the bottom wall 112 and the main top 130 along the vertical direction V.

Referring now to FIGS. 2-5, the main top 130 extends between front and rear edges 132, 134 along the transverse direction T, and between opposing sides 136, 138 along the lateral direction L. The main top 130 may include a bottom surface 140 and a top surface 150. In exemplary embodiments, the bottom surface 140 may be positioned between the front and rear edges 132, 134 along the transverse direction T, and between opposing sides 136, 138 along the lateral direction L.

The bottom surface 140 may define a first plurality of openings 142 extending through the bottom surface 140 to the cavity 122 defined by the burner box 110. The bottom surface 140 may also define a plurality of apertures 144 surrounding each opening of the first plurality of openings 142. In addition, each of the plurality of apertures 144 may extend through the bottom surface 140 to the cavity 122 defined by the burner box 110.

The top surface 150 may be spaced apart from the bottom surface 140 along the vertical direction V. More specifically, the top surface 150 may be spaced apart from (e.g, positioned above) the bottom surface 140 along the vertical direction V. In addition, the top surface 150 may surround a perimeter of the bottom surface 140. In some exemplary embodiments, the top surface 150 may be aligned with the front edge 132, rear edge 134, and opposing sides 136 and 138 of the main top 130 along the vertical direction V. Thus, in some embodiments, the front edge 132, rear edge 134, and the opposing sides 136 and 138 may collectively define a perimeter of the top surface 150.

The top surface 150 may define a second plurality of openings 152. In exemplary embodiments, each of the second plurality of openings 152 may be positioned between the front edge 132 and the bottom surface 140 along the transverse direction T. Furthermore, each of the second plurality of openings 152 may extend through the top surface 150 and into the cavity 122 defined by the burner box 110. As such, air may enter the cavity 122 through the second plurality of openings 152.

It should be appreciated that each opening of the second plurality of openings 152 may define any suitable surface area. For example, in one exemplary embodiment, one or more openings of the second plurality of openings 152 may be between 1 square inch ($in^2$) and 3 square inches ($in^2$).

The main top 130 may also include a transition surface 160 extending between the bottom surface 140 and the top surface 150 along the vertical direction V. The transition surface 160 may include opposing sides 162, 164 spaced apart from one another along the lateral direction L. More specifically, the opposing sides 162, 164 may be positioned between opposing sides 136, 138 along the lateral direction L, and between the front edge 132 and the bottom surface 140 along the transverse direction T. The transition surface 160 may define a length extending between the bottom and top surfaces 140, 150 along the vertical direction V. The transition surface 160 may also define a width extending between opposing sides 162, 164 along the lateral direction L. It should be appreciated that the transition surface 160 may be sloped along its entire length.

Figure 4:
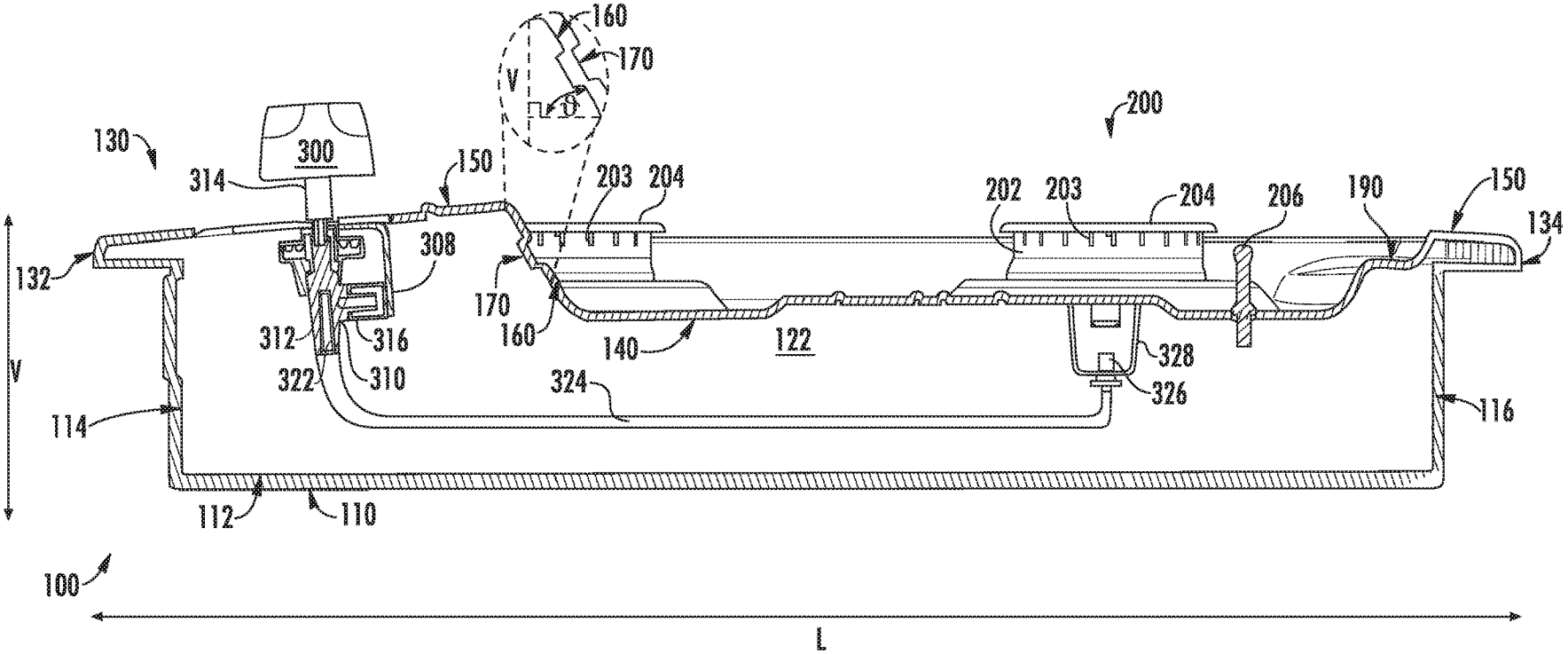
FIG. 4 provides a cross-section, side view of the exemplary cooktop appliance depicted in FIG. 1.
Figure 5:
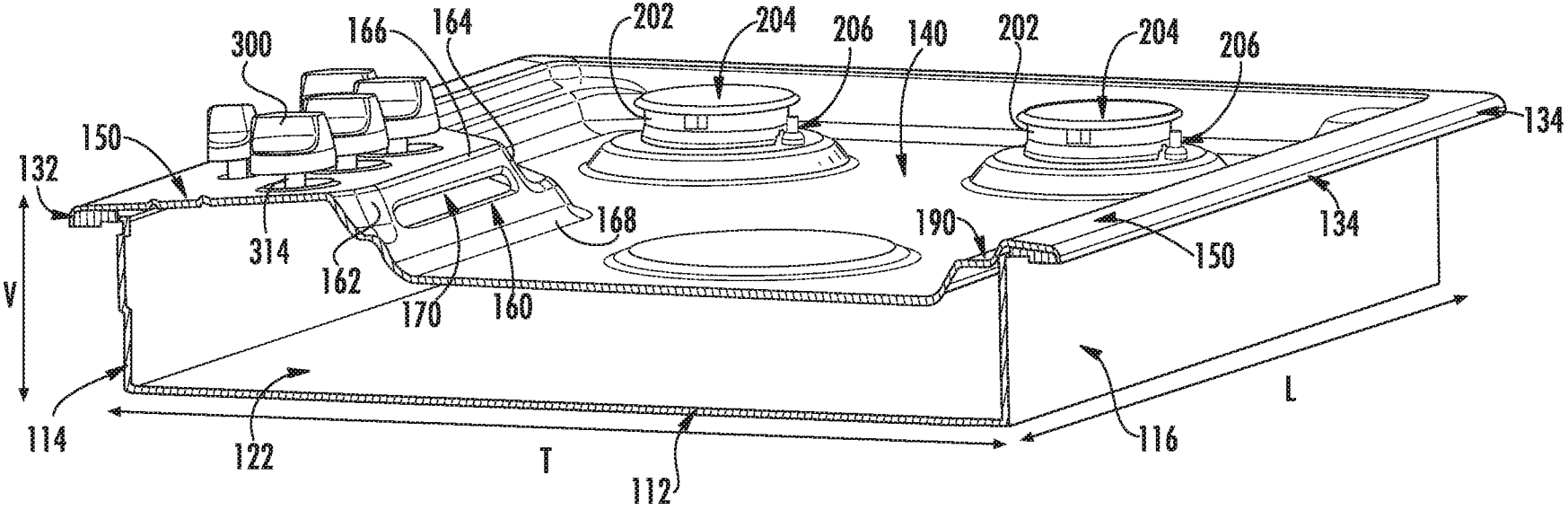
FIG. 5 depicts a cross-section, perspective view of the exemplary cooktop appliance depicted in FIG. 1.

As shown in FIG. 4, the transition surface 160 may define an angle θ relative to a plane that is perpendicular to the vertical direction V. It should be appreciated that the angle θ may be any suitable angle greater than zero degrees (0°) but less than one hundred eighty degrees (180°). For example, in one exemplary embodiment, the angle is angle θ is between forty-five degrees (45°) and seventy degrees (70°). More specifically, in another exemplary embodiment, the angle θ is equal to sixty degrees (60°).

In some exemplary embodiments, the transition surface 160 may be positioned between a first chamfer surface 166 and a second chamfer surface 168 along the vertical direction V. More specifically, the first chamfer surface 166 may extend from the top surface 150 to the transition surface 160 along the vertical direction V, and the second chamfer surface 168 may extend from the bottom surface 140 to the transition surface 160 along the vertical direction V.

The transition surface 160 may define one or more openings 170 positioned between the bottom surface 140 and the second plurality of openings 152 along the transverse direction T. The one or more openings 170 defined by the transition surface 160 may extend along the lateral direction L between opposing sides 162, 164 of the transition surface 160. In addition, the one or more openings 170 may extend through the transition surface 160 to the cavity 122 defined by the burner box 110. As such, air may flow into the cavity 122 through the one or more openings 170 defined by the transition surface 160. It should be appreciated that the one or more openings 170 may define any suitable surface area. For example, in one exemplary embodiment, the one or more openings 170 may define a surface area of at least two square inches (2 $in^2$). In another embodiment, the one or more openings 170 may define a surface area greater than two square inches (2 $in^2$) but less than four square inches (4 $in^2$). In yet another embodiment, the one or more openings 170 may define a surface area greater than four square inches (4 $in^2$).

Figure 6:
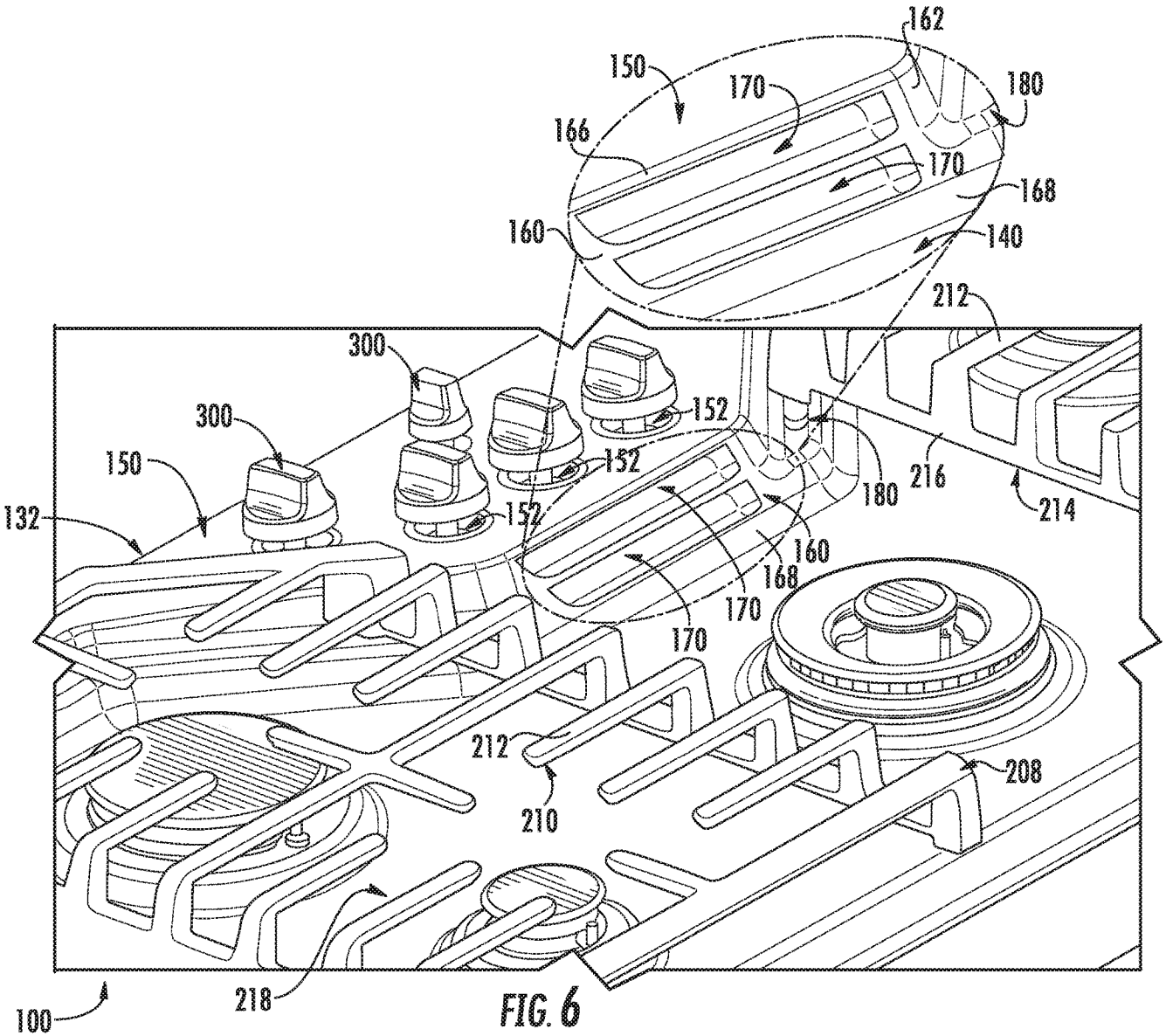
FIG. 6 depicts an enlarged side view of a portion of another exemplary main top of the cooktop appliance.
Figure 7:
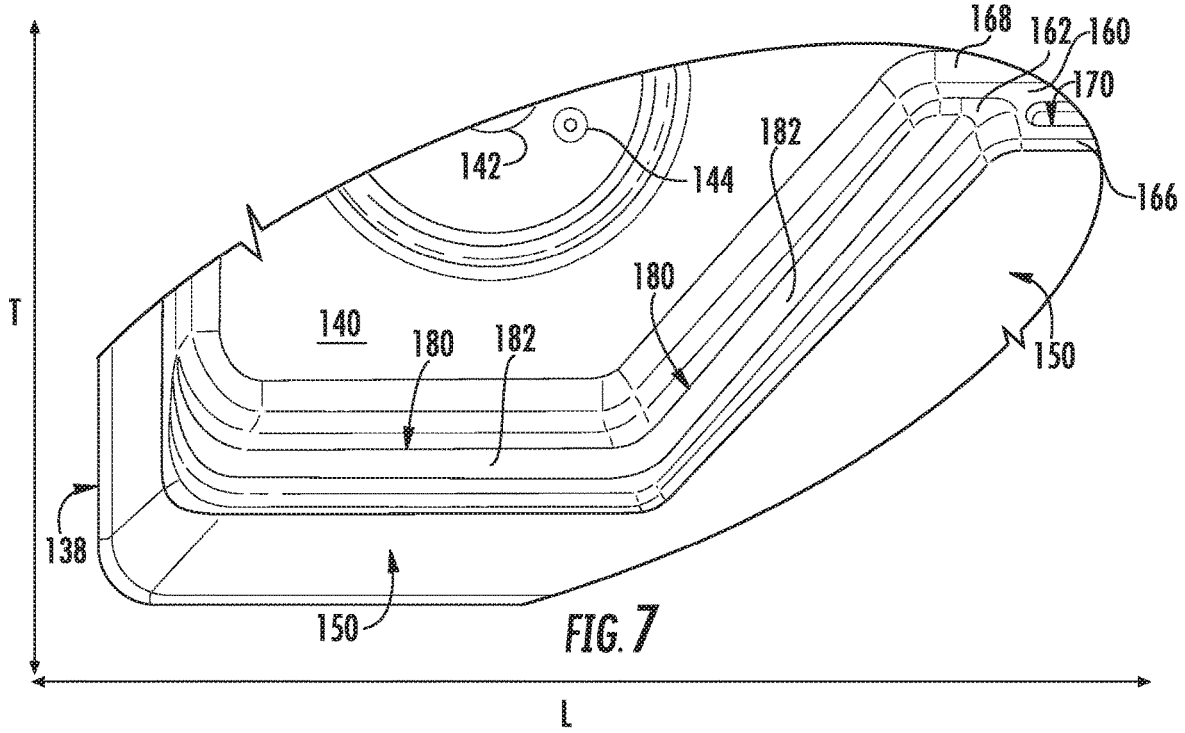
FIG. 7 depicts an enlarged top-down view of a portion of the exemplary main top depicted in FIG. 2.

As shown in FIG. 6, in some exemplary embodiments, the opening 170 defined by the transition surface 160 may include a pair of openings 170 spaced apart from one another along the vertical direction V. Alternatively, or in addition to, the pair of openings may be spaced apart from one another along the lateral direction. The pair of openings 170 may also be positioned between the opposing sides 162, 164 of the transition surface 160 along the lateral direction L. Alternatively, or in addition to, the pair of openings 170 may be positioned between the first chamfer surface 166 and the second chamfer surface 168 along the vertical direction V.

It should be appreciated that the pair of openings 170 depicted in FIG. 6 does not limit the scope of the present subject matter. For example, in an alternative embodiment, the opening 170 defined by the transition surface 160 may include a first pair of openings and a second pair of openings. More specifically, the first and second pair of openings may be spaced apart from one another along the lateral direction. In addition, each opening of the first pair of openings may be spaced apart from one another along the vertical direction V, and each opening of the second pair of openings may be spaced apart from one another along the vertical direction.

In some exemplary embodiments, a surface area defined by each opening of the pair of openings 170 may be equal. For example, the surface area defined by each opening of the pair of openings 170 may be equal to 2 square inches ($in^2$). In alternative embodiments, the surface area defined by each opening of the pair of openings 170 may be different. For example, the surface area defined by one opening of the pair of openings 170 may be equal to 2 square inches ($in^2$), and the surface area defined by the other opening of the pair of openings 170 may be equal to 4 square inches ($in^2$).

Referring now to FIGS. 2, 5, 7, and 8, the main top 130 also includes a front shelf 180 and a rear shelf 190. The front and rear shelves 180, 190 may each be positioned between the bottom and top surfaces 140, 150 along the vertical direction V. In addition, the front shelf 180 and the rear shelf 190 may be spaced apart from one another along the transverse direction T. More specifically, the bottom surface 140 may be positioned between the front and rear shelves 180, 190 along the transverse direction T.

The front shelf 180 may be positioned between the front edge 132 and the bottom surface 140 along the transverse direction. More specifically, the front shelf 180 may extend between the front edge 132 and the bottom surface 140 along a plane that is substantially perpendicular to the vertical direction V. In one exemplary embodiment, the front shelf 180 may be substantially parallel to both the bottom and top surfaces 140, 150. However, in alternative embodiments, the front shelf 180 may be angled relative to the plane that is substantially perpendicular to the vertical direction V and, as a result, may be angled relative to both the bottom and top surfaces 140, 150.

Figure 8:
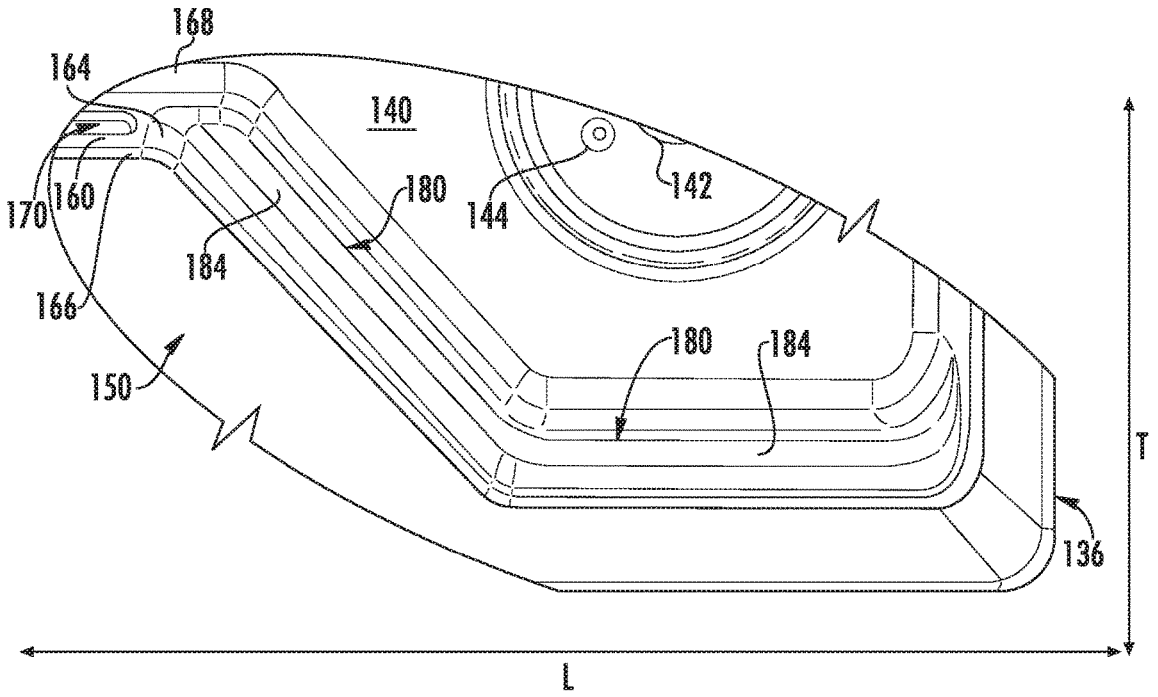
FIG. 8 depicts another enlarged top-down view of a portion of the exemplary main top depicted in FIG. 2.

The front shelf 180 may include a first portion 182 (FIG. 7) and a second portion 184 (FIG. 8). The first portion 182 may extend between the transition surface 160 and opposing side 138 of the main top 130. More specifically, the first portion 182 may extend along the lateral direction L between opposing side 162 of the transition surface 160 and opposing side 138 of the main top 130. The second portion 184 may extend between the transition surface 160 and opposing side 136 of the main top 130. More specifically, the second portion 184 may extend between opposing side 164 of the transition surface 160 and opposing side 136 of the main top 130 along the lateral direction L.

The rear shelf 190 may be spaced apart from the transition surface 160 along the transverse direction T. As shown, the rear shelf 190 may extend between the rear edge 134 and the bottom surface 140 along the transverse direction T. More specifically, the rear shelf 190 may extend between the rear edge 134 and the bottom surface 140 along a plane that is substantially perpendicular to the vertical direction V. In one exemplary embodiment, the rear shelf 190 may be substantially parallel to both the bottom and top surfaces 140, 150. However, in alternative embodiments, the rear shelf 190 may be angled relative to the plane that is substantially perpendicular to the vertical direction V and, as a result, may be angled relative to both the bottom and top surfaces 140, 150. As will be discussed below in greater detail, the front and rear shelves 180, 190 may be used to support a grate.

Referring again to FIGS. 3-5, the cooktop appliance 100 also includes a plurality of gas burner assemblies 200. Each gas burner assembly 200 includes a burner base 202, a burner cap 204, and an igniter 206 (e.g., spark electrode). The burner base 202 includes a plurality of flame ports 203 and, as shown, may be positioned on the bottom surface 140 of the main top 130. More specifically, the burner base 202 may surround one of the first plurality of openings 142 defined by the bottom surface 140. The burner cap 204 may rest on the burner base 202. The igniter 206 may be spaced apart from the burner base along at least one of the transverse direction T and the lateral direction L. In addition, the igniter 206 may, at least in part, be positioned within the cavity 122 defined by the burner box 110. More specifically, the igniter 206 may extend out of the cavity 122 through one of the plurality of apertures 144 defined by the bottom surface 140. As will be discussed below in more detail, the igniter 206 may ignite a gaseous fuel/air mixture exiting the burner base 202 through one or more of the plurality of flame ports 203.

The cooktop appliance 100 may also include a grate 208. The grate 208 may be support a cooking utensil, such as a pot, pan, etc. For example, the grate 208 may include a plurality of tines or elongated members 210, e.g., formed of cast metal, such as cast iron. Each of the elongated members 210 may be spaced apart from the plurality of flame ports 203 along the vertical direction V. A cooking utensil (e.g., a pot) may be placed on the elongated members 210 of the grate 208 such that the cooking utensil, e.g., a bottom surface of the cooking utensil, rests on an upper surface 212 of the elongated members 210. Thus, it should be appreciated that the port to pot height may be measured along the vertical direction V between the plurality of flame ports 203 and the upper surface 212 of the elongated member 210.

The elongated members 210 of the grate 208 may include an outer frame 214 that extends around or defines a perimeter of the grate 208 and/or the gas burner assembly 200. Thus, the outer frame 214 may be positioned at an outer portion 216 of the grate 208. The grate 208 may rest on the panel 102 at the outer frame 214 of the grate 208. Thus, a bottom surface of the outer frame 214 may rest on the front and rear shelves 180, 190 of the main top 130. As shown, the outer frame 214 of the grate 208 may be square or rectangular in certain exemplary embodiments. Within the outer frame 214, the elongated members 210 may define an inner passage 218 that extends vertically through the grate 208. Thus, fluid, such as air, may flow through the grate 208 via the inner passage 218.

The cooktop appliance 100 also includes knobs 300 and a control valve 310 (only one shown) positioned at or adjacent one of the second plurality of openings 152 of the top surface 150. As an example, the knobs 300 and the control valve 310 may be positioned opposite each other about the top surface 150. In particular, the knobs 300 are positioned outside of the cavity 122 proximate to one of the second plurality of openings 152, and the control valve 310 is positioned within the cavity 122 proximate to one of the second plurality of openings 152.

The knobs 300 are associated with each one of the gas burner assemblies 200. The knobs 300 allow a user to activate each burner assembly 200 and determine the amount of heat input each gas burner assembly 200 provides to a cooking utensil located thereon. The control valve 310 may include, for example, a valve body 312, a rotatable member 314, a manifold 316, a manifold bracket 318, an inlet 320, and an outlet 322. The valve body 312 may be configured for housing various components of the control valve 310 that regulate a flow of gaseous fuel, such as propane or natural gas, from the manifold 316 to the inlet 320. In particular, the control valve 310 is selectively adjustable between an open position and a closed position. In the closed position, the control valve 310 blocks gaseous fuel flow from the manifold 316 to the inlet 320. The rotatable member 314 extends from the valve body 312 through the top surface 150 at one of the second plurality of openings 152. Each of the knobs 300 is coupled to (e.g., mounted to) the rotatable member 214. A user may rotate one of the knobs 300 in order to adjust the control valve 310 between the open and closed positions. The outlet 322 of the control valve 310 extends from the valve body 312 to one of the burner assemblies 200 in order to supply fuel from the valve body 312 thereto. More specifically, a gas tube 324 may be coupled to the outlet 322, and the gas tube 324 may extend between the outlet 322 and one of the burner assemblies 200.

In one exemplary embodiment, the gas tube 324 may be coupled to a fuel orifice 326 positioned directly beneath one of the first plurality of openings 142 along the vertical direction V. Gaseous fuel exiting the gas tube 324 at the fuel orifice may entrain and mix with air in the cavity 122. The mixture of gaseous fuel and air may exit the cavity 122 through one of the first plurality of openings 142, and may flow into the burner base 202. Then, the mixture of gaseous fuel and air may exit the burner base 202 through the plurality of flame ports 203, and may be ignited by the igniter 206 to produce a flame. As will be discussed below in more detail, the main top 130 may define openings at other locations to increase the amount of air entering the cavity 122 during operation of the cooktop appliance 100.

In some exemplary embodiments, the gas tube 324 may be coupled to a mounting bracket 328. The mounting bracket 328 may be positioned beneath the bottom surface 140 along the vertical direction V. In addition, the mounting bracket 328 may include a plurality of apertures (not shown) extending through a surface of the mounting bracket 328. More specifically, each aperture defined by the mounting bracket 328 may be aligned with one of the plurality of apertures 144 along the vertical direction V. The main top 130 may be secured to the mounting bracket 328 via a mechanical fastener (not shown) extending along the vertical direction V through one of the plurality of apertures 144 defined by the bottom surface 140 and one the plurality of apertures defined by the mounting bracket 328.

Figure 9:
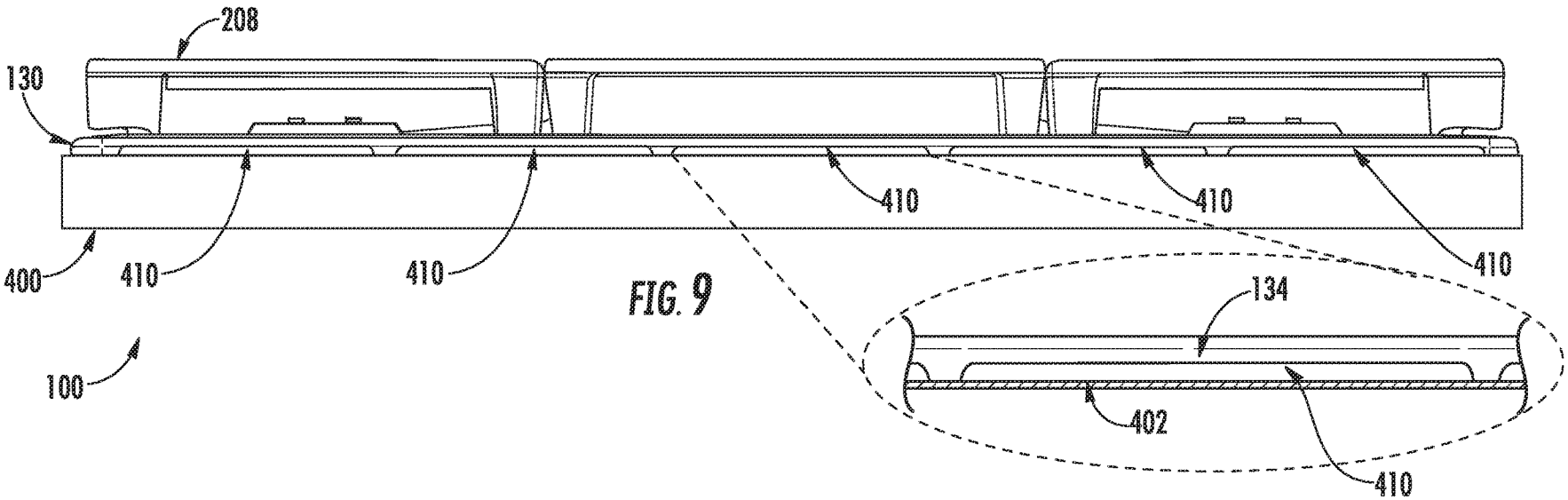
FIG. 9 depicts a rear view of another exemplary embodiment of an exemplary cooktop appliance.

FIG. 9 depicts another exemplary embodiment of the cooktop appliance 100. The cooktop appliance 100 is configured in substantially the same manner as the exemplary cooktop appliance 100 depicted in FIG. 1, and accordingly, the same or similar numbers may refer to the same or similar parts. As shown, the cooktop appliance 100 is recessed 200 within a countertop 400. However, the front edge 132, rear edge 134, and opposing sides 136, 138 of the main top 130 are each spaced apart from the countertop 400 along the vertical direction V. More specifically, a bottom portion of the front edge 132, rear edge 134, and opposing sides 136, 138 rests on a top surface 402 of the countertop 400.

As shown, the rear edge 134 defines a plurality of openings 410 which, in some exemplary embodiments, may be spaced apart from one another along the lateral direction L. Each opening of the plurality of openings 410 extends along the vertical direction V between the rear edge 134 of the main top 130 and the top surface 402 of the cabinet 400. In addition, each opening of the plurality of openings 410 extends through the rear edge 134 to the cavity 122 defined by the burner box 110. Accordingly, air may enter the cavity 122 through each of the plurality of openings 410. Additionally, air may also enter the cavity 122 through the one or more openings 170 (FIG. 4) defined by the transition surface 160.

Figure 10:
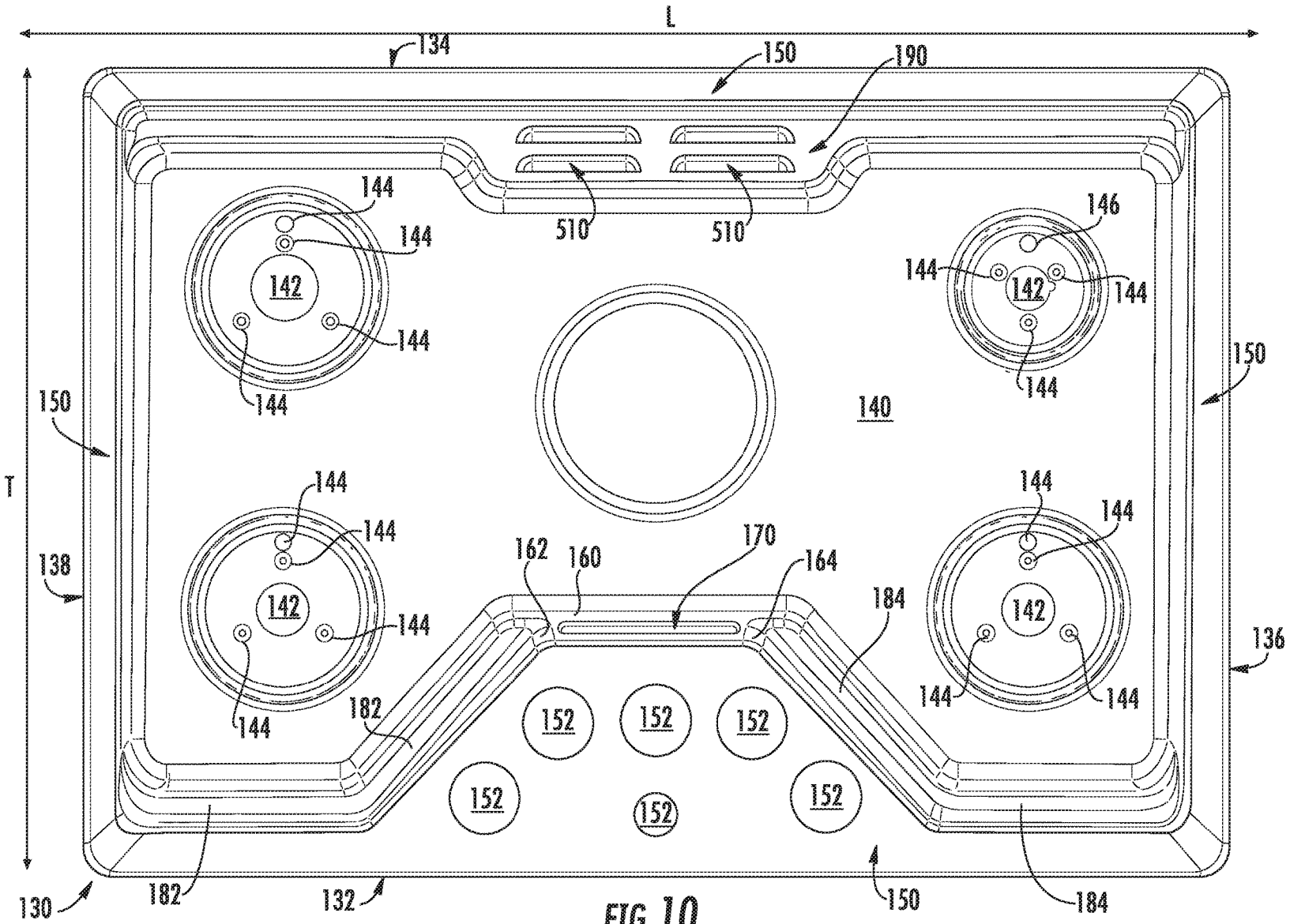
FIG. 10 depicts a top-down view of another exemplary embodiment of a main top of a cooktop appliance.

FIG. 10 depicts another exemplary embodiment of a main top 130. The main top 130 is configured in substantially the same manner as the main top 130 depicted in FIG. 2, and accordingly, the same or similar numbers may refer to the same or similar parts. As shown, the rear shelf 190 of the main top 130 defines a plurality of openings 510. Each opening of the plurality of openings 510 defined by the rear shelf 190 may be positioned between the first and second portions 182, 184 of the front shelf 180 along the lateral direction L. It should be appreciated that each of the plurality of openings 510 extends through the rear shelf 190 to the cavity 122 defined by the burner box 110. Accordingly, air may enter the cavity 122 through each opening of the plurality of openings 510 defined by the rear shelf 190. In addition, air may also enter the cavity 122 through the one or more openings 170 defined by the transition surface 160.

Figure 11:
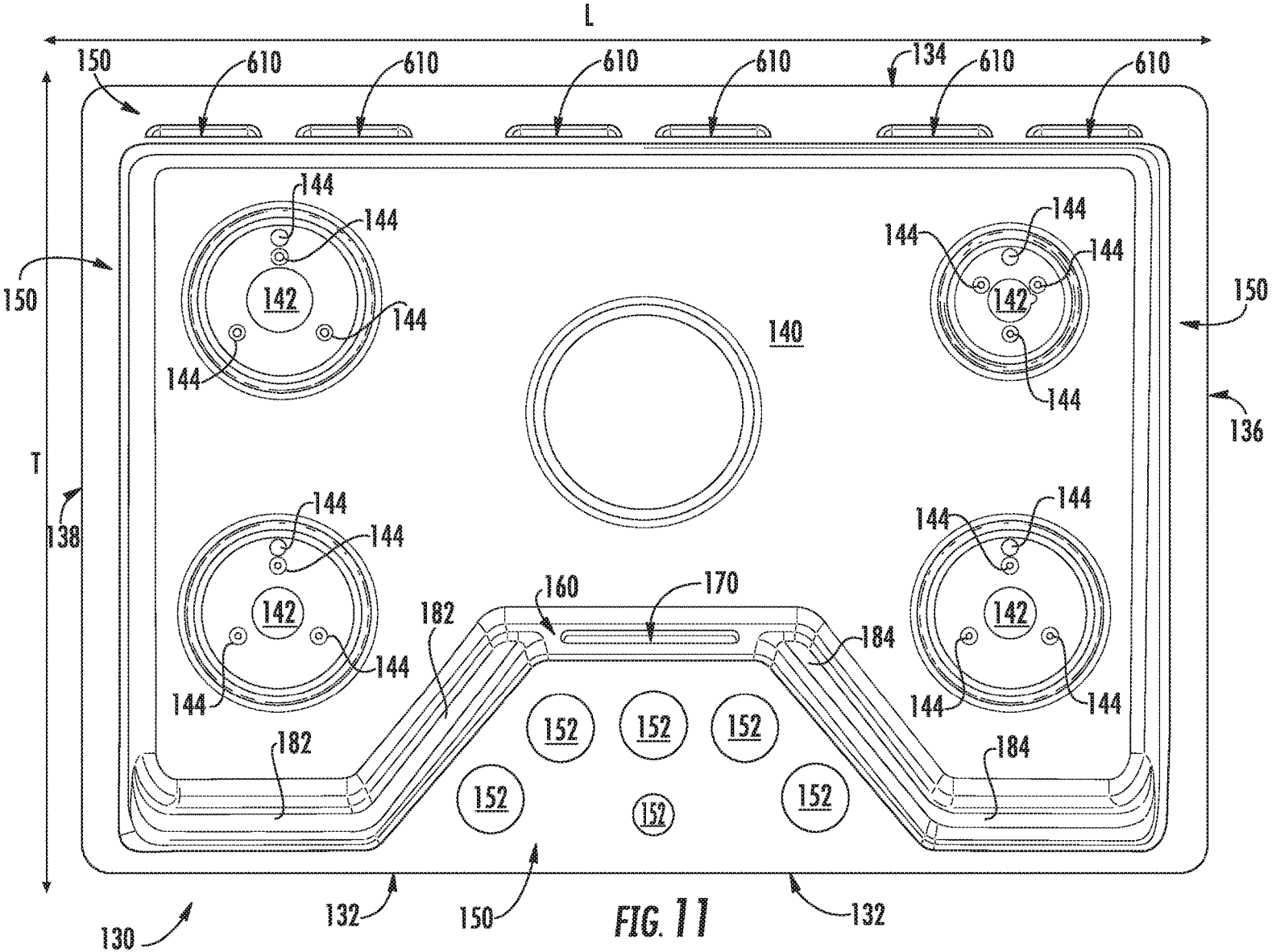
FIG. 11 depicts a top-down view of yet another exemplary main top of a cooktop appliance.

FIG. 11 depicts yet another exemplary embodiment of the main top 130. The main top 130 is configured in substantially the same manner as the main top 130 depicted in FIG. 2, and accordingly, the same or similar numbers may refer to the same or similar parts. As shown, the top surface 150 may define a third plurality of openings 610 positioned between the bottom surface 140 and the rear edge 134 along the transverse direction T, and between opposing sides 136, 138 along the lateral direction L. Each opening of the third plurality of openings 610 may be spaced apart from one another along the lateral direction L. In addition, each opening of the third plurality of openings 610 may extend through the top surface 150 to the cavity 122 defined by the burner box 110. Accordingly, air may enter the cavity 122 through each opening of the third plurality of openings 610. In addition, air may also enter the cavity 122 through the one or more openings 170 defined by the transition surface 160.

Figure 12:
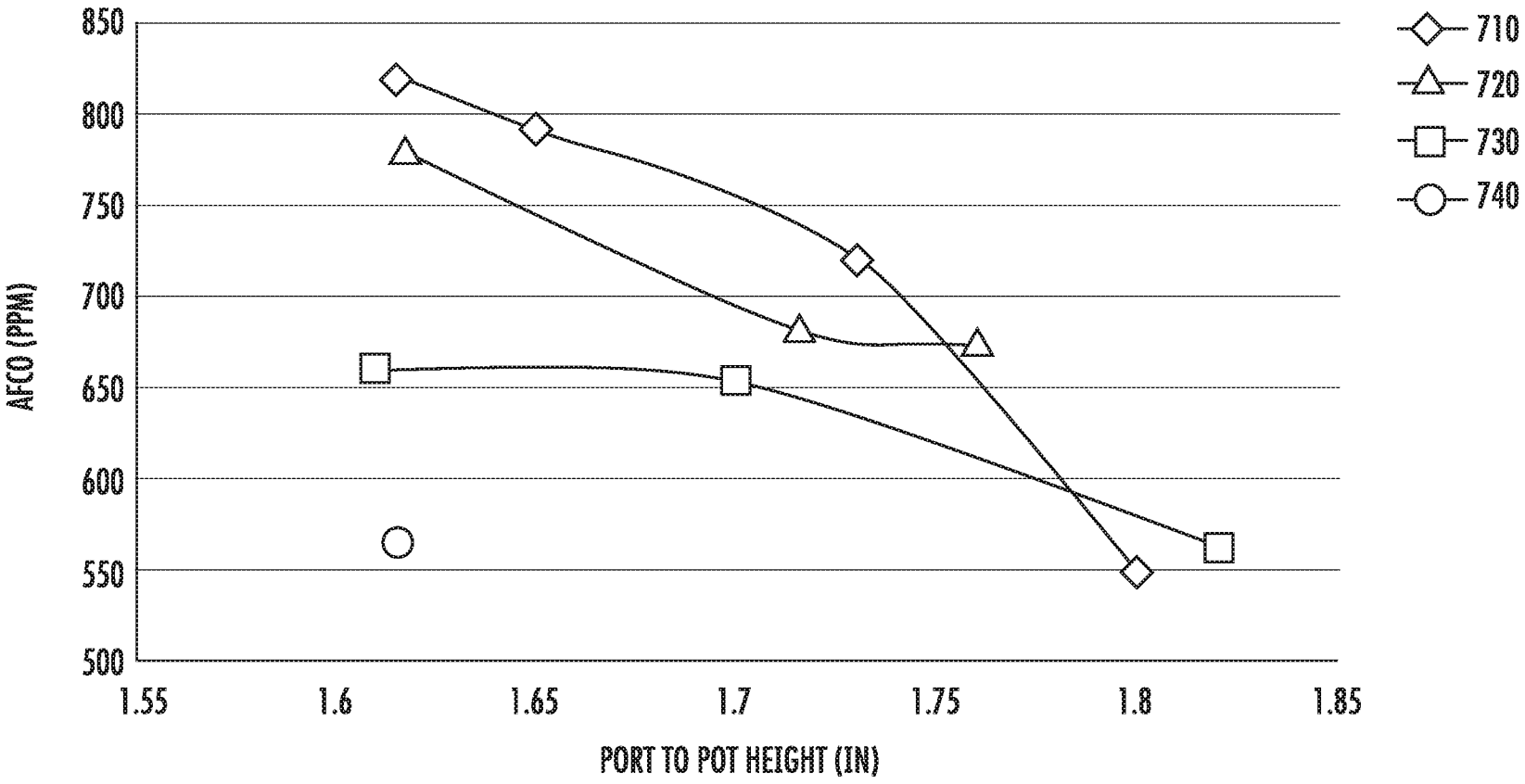
FIG. 12 illustrates plots indicating the effect exemplary embodiments of the main top have on AFCO production levels and port-to-pot height.

FIG. 12 provides a graph indicating the effect increasing the volume of air entering the cavity 122 of the burner box 110 has on AFCO production levels and port-to-pot height. More specifically, the graph indicates the advantages of providing air to the cavity 122 of the burner box 110 through openings defined on the main top 130. As shown, the graph includes a first plot 710 indicating the performance of the gas burners when the main top 130 includes only the second plurality of openings 152 defined by the top surface 150. The second plot 720 indicates the performance of the gas burners when the main top 130 includes, in addition to the second plurality of openings 152, the plurality of openings 510 defined by the rear shelf 190. In particular, the second plot 720 is specific to embodiments in which each opening of the plurality of openings 510 defines a surface area of two square inches (2 $in^2$). The third plot 730 indicates the performance of the gas burners when the main top 130 includes, in addition to the second plurality of openings 152, the one or more openings 170 defined by the transition surface 160. In particular, the third plot 730 is specific to embodiments in which the one or more openings 170 define a surface area of two square inches (2 $in^2$). Lastly, the fourth plot 740 is specific to embodiments in which the one or more openings 170 define a surface area of four square inches (4 $in^2$).

The second, third, and fourth plots 720, 730, 740 indicate the effect additional opening(s), beyond the second plurality of openings 152, have on both AFCO production levels and port-to-pot height. More specifically, the second, third, and fourth plots 720, 730, 740 indicate that the size (e.g., surface area) and location of the additional opening(s) can affect each of these parameters (e.g., AFCO levels and port-to-pot height) differently. For instance, if the surface area of the one or more openings 170 and the plurality of openings 510 are both equal to two square inches ($in^2$), the one or more openings 170 defined on the transition surface 160 provide greater reductions in AFCO production levels as compared to the plurality of openings 510 defined by the rear shelf 190. Consequently, the port-to-pot height may be lower when the cooktop appliance 100, specifically the main top 130 thereof, includes the one or more openings 170 defined on the transition surface 160. In addition, the third and fourth plots 730, 740 indicate that increasing the surface area of the one or more openings 170 from two square inches ($in^2$) to four square inches ($in^2$) provides even further reductions to AFCO production levels, which allows the port-to-pot height to be even further reduced.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A main top of a gas cooktop appliance defining a vertical direction, a lateral direction, and a transverse direction, the vertical, lateral, and transverse directions being mutually perpendicular, the main top comprising:

a front edge and a rear edge spaced apart from one another along the transverse direction;

a first side and a second side spaced apart from one another along the lateral direction, the first side and the second side each extending between the front edge and the rear edge along the transverse direction;

a bottom surface positioned between the front edge and the rear edge along the transverse direction, the bottom surface defining a first plurality of openings;

a top surface spaced apart from the bottom surface along the vertical direction such that the top surface is parallel relative to the bottom surface, the top surface surrounding a perimeter of the bottom surface, the top surface defining a second plurality of openings positioned between the bottom surface and the front edge along the transverse direction, the top surface further defining a third plurality of opening positioned between the bottom surface and the rear edge along the transverse direction;

a transition surface extending between the bottom surface and the top surface along the vertical direction, the transition surface spaced apart from the front edge along the transverse direction, the transition surface defining an opening;

a front shelf extending between the bottom surface and the front edge along a plane that is perpendicular to the vertical direction, the front shelf positioned between the bottom surface and the top surface along the vertical direction, the front shelf comprising a first portion and a second portion, the first portion extending between the transition surface and the first side along the lateral direction, the second portion extending between the transition surface and the second side along the lateral direction; and a rear shelf spaced apart from the front shelf along the transverse direction, the rear shelf extending between the bottom surface and the rear edge along the plane that is perpendicular to the vertical direction, the rear shelf positioned between the bottom surface and the top surface along the vertical direction, wherein when the main top is mounted to a burner box of the gas cooktop appliance, the opening defined by the transition surface is in fluid communication with the third plurality of openings via a cavity defined by the burner box.

2. The main top of claim 1, wherein the transition surface extends between the top surface and the bottom surface at an angle relative to a plane that is perpendicular to the vertical direction.

3. The main top of claim 1, wherein the opening defined by the transition surface is positioned between the bottom surface and the second plurality of openings along the transverse direction.

4. The main top of claim 3, wherein the opening defined by the transition surface includes a pair of openings spaced apart from one another along the vertical direction.

5. The main top of claim 1, further comprising a first chamfer surface and a second chamfer surface, the transition surface positioned between the first and second chamfer surfaces along the vertical direction.

6. The main top of claim 5, wherein the first chamfer surface extends from the top surface to the transition surface along the vertical direction, and wherein the second chamfer surface extends from the bottom surface to the transition surface along the vertical direction.

7. The main top of claim 1, wherein the opening defined by the transition surface defines a surface area between approximately two square inches and four square inches.

8. The main top of claim 1, wherein the rear shelf defines a plurality of openings, and wherein each opening of the plurality of openings extends through the rear shelf.

9. A gas cooktop appliance defining a vertical direction, a lateral direction, and a transverse direction, the vertical, lateral, and transverse directions being mutually perpendicular, the gas cooktop appliance comprising:

a plurality of gas burner assemblies, each of the plurality of gas burner assemblies comprising a burner base;

a plurality of knobs, each of the plurality of knobs operatively coupled to one of the plurality of gas burner assemblies;

a burner box defining a cavity; and a main top positioned on the burner box, the main top comprising:

a front edge and a rear edge spaced apart from one another along the transverse direction;

a first side and a second side spaced apart from one another along the lateral direction, the first side and the second side each extending between the front edge and the rear edge along the transverse direction;

a bottom surface positioned between the front edge and the rear edge along the transverse direction, the bottom surface defining a first plurality of openings extending through the bottom surface to the cavity defined by the burner box;

a top surface spaced apart from the bottom surface along the vertical direction such that the top surface is parallel relative to the bottom surface, the top surface surrounding a perimeter of the bottom surface, the top surface defining a second plurality of openings and a third plurality of openings, the second plurality of openings positioned between the bottom surface and the front edge along the transverse direction, the third plurality of openings positioned between the bottom surface and the rear edge along the transverse direction;

a transition surface extending between the bottom surface and the top surface along the vertical direction, the transition surface spaced apart from the front edge along the transverse direction, the transition surface defining an opening extending through the transition surface to the cavity defined by the burner box;

a front shelf extending between the bottom surface and the front edge along a plane that is perpendicular to the vertical direction, the front shelf positioned between the bottom surface and the top surface along the vertical direction, the front shelf comprising a first portion and a second portion, the first portion extending between the transition surface and the first side along the lateral direction, the second portion extending between the transition surface and the second side along the lateral direction; and a rear shelf spaced apart from the front shelf along the transverse direction, the rear shelf extending between the bottom surface and the rear edge along the plane that is perpendicular to the vertical direction, the rear shelf positioned between the bottom surface and the top surface along the vertical direction, wherein when the main top is mounted to a burner box of the gas cooktop appliance, the opening defined by the transition surface is in fluid communication with the third plurality of openings via a cavity defined by the burner box.

10. The gas cooktop appliance of claim 9, wherein the transition surface extends between the top surface and the bottom surface at an angle relative to a plane that is perpendicular to the vertical direction.

11. The gas cooktop appliance of claim 9, wherein the opening defined by the transition surface is positioned between the bottom surface and the second plurality of openings along the transverse direction.

12. The gas cooktop appliance of claim 9, wherein the rear edge defines a plurality of openings extending through the rear edge to the cavity defined by the burner box.

13. The gas cooktop appliance of claim 12, wherein the plurality of openings defined by the rear edge are spaced apart from one another along the lateral direction.

14. The gas cooktop appliance of claim 13, further comprising a countertop having a top surface, and wherein each opening of the plurality of openings defined by the rear edge extends between the top surface of the countertop and the rear edge along the vertical direction.

15. The gas cooktop appliance of claim 9, wherein the rear shelf defines a plurality of openings, and wherein each opening of the plurality of openings defined by the rear shelf extends through the rear shelf to the cavity defined by the burner box.

16. The gas cooktop appliance of claim 9, wherein:

each opening of the second plurality of openings extends through the top surface to the cavity defined by the burner box; and each opening of the third plurality of openings extends through the top surface to the cavity defined by the burner box.

* * * * *